US005336425A

United States Patent [19]

Aoki et al.

[11] Patent Number: 5,336,425

[45] Date of Patent: Aug. 9, 1994

[54] ACIDIC ALUMINUM CLEANER CONTAINING AN OXIDANT AND A NONIONIC SURFACTANT STABILIZED BY A GLYCOL

[75] Inventors: Tomoyuki Aoki; Yasuo Iino; Yoji Ono; Shinichiro Asai, all of Kanagawa, Japan

[73] Assignee: Henkel Corporation, Plymouth Meeting, Pa.

[21] Appl. No.: 971,924

[22] PCT Filed: Jun. 14, 1992

[86] PCT No.: PCT/US91/04263

§ 371 Date: Dec. 21, 1993

§ 102(e) Date: Dec. 21, 1993

[30] Foreign Application Priority Data

Jun. 19, 1990 [JP] Japan ..... 2-160442

[51] Int. Cl.[5] ..... C11D 1/72; C23F 1/20; C23F 1/22; C23G 1/12

[52] U.S. Cl. ..... 252/100; 134/3; 134/41; 156/665; 252/79.2; 252/79.4; 252/101; 252/136; 252/142; 252/143; 252/173; 252/174.21

[58] Field of Search ..... 134/3, 41; 156/665; 252/79.1, 79.2, 79.4, 100, 101, 136, 142, 143, 173

[56] References Cited

U.S. PATENT DOCUMENTS

| | | | |
|---|---|---|---|
| 4,851,148 | 7/1989 | Yamasoe | 252/142 |
| 4,944,807 | 7/1990 | Sova | 134/3 |
| 4,970,015 | 11/1990 | Garcia | 252/79.4 |
| 4,980,076 | 12/1990 | Tanaka | 252/79.4 |

FOREIGN PATENT DOCUMENTS

| | | |
|---|---|---|
| 0196668 | 10/1986 | European Pat. Off. . |
| 0361102 | 4/1990 | European Pat. Off. . |
| 61-106783 | 5/1986 | Japan . |
| 61-231188 | 10/1986 | Japan . |
| 63-223798 | 9/1988 | Japan . |
| 1157038 | 7/1969 | United Kingdom . |

OTHER PUBLICATIONS

Chem. Abstracts, vol. 82, No. 2, Jan. 13, 1975, Japan Kokai 74 74,630 (No Month Available).

*Primary Examiner*—Dennis Albrecht
*Attorney, Agent, or Firm*—Ernest G. Szoke; Wayne C. Jaeschke; Norvell E. Wisdom, Jr.

[57] ABSTRACT

The stability of an acidic liquid cleaner for aluminum comprising mineral acid, oxidant, polyvalent metal ions, and surfactant is substantially improved by the presence in the cleaner of from 0.05 to 5 g/L of a component selected from the group of glycols containing from 2 to 10 carbon atoms per molecule and mixtures of such glycols. The effectiveness of the cleaner for primary cleaning and de-smutting of aluminum and its alloys is not impaired and may even be improved by the addition of the glycol component.

20 Claims, No Drawings

ACIDIC ALUMINUM CLEANER CONTAINING AN OXIDANT AND A NONIONIC SURFACTANT STABILIZED BY A GLYCOL

TECHNICAL FIELD

The present invention relates to an acidic liquid cleaner for articles, such as sheets, strips, containers, and the like, that are made of aluminum or of aluminum alloys that are predominantly aluminum (both hereinafter designated briefly as "aluminum" unless the context requires otherwise). The cleaner is very effective in maintaining its etching capacity and in removing the smut produced by the etching of an aluminum surface as well as in general cleaning.

BACKGROUND ART

Due to problems with waste water treatment, acidic liquid cleaners for aluminum are currently being converted from the fluorine-based cleaners used heretofore to fluorine-free, chromium-free cleaners.

The acidic liquid aluminum cleaners disclosed in, for example, (a) Japanese Patent Application Laid Open [Kokai] Number 61-106783 [106,783/86], (b) Japanese Patent Application Laid Open Number 61-231188 [231,188/86], and (c) Japanese Patent Application Laid Open Number HEI 2-73983 [73,983] are examples of prior art fluorine-free, chromium-free cleaners. The liquid cleaners disclosed in (a) and (b) are sulfuric acid-based acidic liquid cleaners for aluminum. In addition to sulfuric acid, nitric acid, and surfactant, these also contain ferric ion (etching accelerator) and an oxidant (stabilizer for the ferric ion). These compositions are heated to 50° to 80° C. for use in cleaning. The liquid cleaner in (c) is a phosphoric acid-based acidic liquid cleaner for aluminum. In addition to phosphoric acid, sulfuric acid, and surfactant, it contains small amounts of ferric ion (in order to inhibit corrosion of the cleaning equipment) and an oxidant which acts as a stabilizer for the ferric ion. It is heated to 50° to 80° C. for use in cleaning.

DESCRIPTION OF THE INVENTION

Problem to Be Solved by the Invention

These prior art examples are all acidic liquid aluminum cleaners composed of mineral acid, ferric ion, oxidant, and surfactant, and as such they suffer from common problems. Thus, because they are fluorine-free, chromium-free cleaners, their treatment temperatures are higher than for fluorine-based cleaners. Moreover, because they contain oxidant and metal ion, surfactant decomposition occurs to a substantial extent. Not only does this increase consumption of the surfactant, but decomposition product remaining in the treatment bath impairs its degreasing performance. As a consequence, these cleaners lack a robust, durable cleaning activity.

SUMMARY OF THE INVENTION

The present invention seeks to introduce a concrete means for solving the problems outlined hereinbefore for acidic liquid aluminum cleaners comprising mineral acid, oxidant, polyvalent metal ions, and surfactant. It has been found that the problems observed with such cleaners in the prior art are largely or entirely avoided by addition to such an acidic liquid cleaner of 0.05 to 5 grams per liter (hereinafter "g/L") of a component selected from the group of $C_2$ to $C_{10}$ glycols.

DETAILED OF PREFERRED EMBODIMENTS OF THE INVENTION

In more specific terms, a preferred acidic liquid aluminum cleaner with a robust, durable cleaning activity can be obtained by preparing the acidic liquid aluminum cleaner as follows:

the aforesaid mineral acid comprises at least one selection from phosphoric acid, sulfuric acid, and nitric acid; the concentrations of phosphoric acid and sulfuric acid do not exceed 20 g/L; and the nitric acid concentration does not exceed 10 g/L;

the aforesaid oxidant is hydrogen peroxide or a nitrite, and its concentration is in the range from 0.02 to 3.0 g/L;

the aforesaid polyvalent metal ion is ferric ion, and the ferric ion content is 0.02 to 5 g/L;

the aforesaid surfactant is nonionic, and the surfactant content is in the range from to 0.1 to 5 g/L;

there is additionally present at least 1 selection from the $C_2$ to $C_{10}$ glycols such as propylene glycol, ethylene glycol, diethylene glycol, and triethylene glycol; and the pH of this acidic liquid cleaner does not exceed 2.0.

The simultaneous presence of surfactant, polyvalent metal ion (for example, ferric ion), and oxidant in the acidic liquid aluminum cleaner according to the present invention is essential for the effective maintenance of a degreasing capacity and aluminum etchability. In addition, the presence of such compounds also functions to inhibit corrosion of the cleaning equipment.

The mineral acid is exemplified by sulfuric acid, nitric acid, phosphoric acid, and the like, and at least one selection therefrom should be added. The preferable concentrations are as follows: not more than 20 g/L for phosphoric acid, not more than 20 g/L for sulfuric acid, and not more than 10 g/L for nitric acid. This mineral acid may take the form of a single acid or may comprise a combination of two or more acids which is freely selected within a range which does not adversely affect the surface cleaning performance. Such mixed acids are exemplified by tricomponent mixed acids of 3 to 10 g/L phosphoric acid, 5 to 15 g/L sulfuric acid, and 0.5 to 2 g/L nitric acid, and by bicomponent mixed acids of 10 to 20 g/L sulfuric acid and 0.5 to 2 g/L nitric acid.

Through the use of these mineral acids, the pH preferably does not exceed 2.0 and more preferably is 0.6 to 2. When the pH exceeds 2, the aluminum etching rate is reduced and a satisfactory surface cleaning usually cannot be obtained. No particular restriction is placed on the lower pH limit.

No specific restriction is placed on the polyvalent metal ion, this component being exemplified by Fe ions, Co ions, Sn ions, Ce ions, and the like. However, this component most preferably comprises, or more preferably consists essentially or, most preferably, entirely of, 0.02 to 5 g/L ferric ion ($Fe^{+3}$), which can be furnished, for example, by ferric sulfate or ferric nitrate. Moreover, ferrous ions (e.g., from ferrous sulfate or ferrous nitrate) may be added to the acidic liquid cleaner and then oxidized to ferric ions by the oxidant.

No particular limitation is placed on the oxidant, but it is preferably $H_2O_2$ or $NO_2^-$ present at 0.02 to 3.0 g/L.

The surfactant component should be nonionic surfactants, as exemplified by hydrocarbon derivatives, abietic acid derivatives, ethoxylated primary alcohols, and modified polyethoxylated alcohols, and these may be used singly or in combinations of two or more. The preferable concentration is 0.1 to 10 g/L and more preferably 0.5 to 3 g/L.

With regard to the glycol which is used in order to inhibit surfactant decomposition, propylene glycol is effective in this regard, but ethylene glycol, diethylene glycol, triethylene glycol, etc., are also effective.

At least one of these or other glycols with 2–10 carbon atoms per molecule is used, suitably at 0.05 to 5 g/L and preferably at 0.2 to 2 g/L, referred to the treatment composition.

The $C_2$ to $C_{10}$ glycol present in the acidic liquid aluminum cleaner according to the present invention substantially inhibits decomposition of the surfactant by the polyvalent metal ions and oxidant and thus improves the durability of the cleaning activity.

are reported in Table 1. The four surfactants identified by number in Table 1 had the following chemical characteristics:

nonionic (1): nonylphenol/EO (20 moles) adduct (hydrocarbon derivative)

nonionic (2): higher alcohol/EO (5 moles)-PO (10 moles) adduct (hydrocarbon derivative)

nonionic (3): nonylphenol/EO (14 moles) adduct (hydrocarbon derivative)

nonionic (4): higher alcohol/EO (5 moles)-PO (15 moles) adduct (hydrocarbon derivative)

Five test baths were also prepared by the omission of the $C_2$ to $C_{10}$ glycol from Examples 1 to 5, and these are reported in Table 2 as comparison examples 1 to 5 respectively.

TABLE 1

| (Examples) | phosphoric acid as $PO_4$ | sulfuric acid as $SO_4$ | nitric acid as $NO_3$ | ferric ion $Fe^+$ | ferric ion counterion | oxidant $H_2O_2$ | $C_2$–$C_{10}$ glycol | surfactant |
|---|---|---|---|---|---|---|---|---|
| 1 | 6 g/L | 9 g/L | 1.0 g/L | 0.05 g/L | $SO_4^{2-}$: 0.13 g/L | 0.5 g/L | propylene glycol 0.5 g/L | nonionic (1) 0.5 g/L<br>nonionic (2) 1.5 g/L |
| 2 | 6 g/L | 9 g/L | 1.0 g/L | 0.05 g/L | $SO_4^{2-}$: 0.13 g/L | 0.5 g/L | propylene glycol 1.5 g/L | nonionic (1) 0.5 g/L<br>nonionic (2) 1.5 g/L |
| 3 | — | 15 g/L | 1.0 g/L | 1.00 g/L | $SO_4^{2-}$: 2.60 g/L | 0.5 g/L | propylene glycol 0.5 g/L | nonionic (1) 0.5 g/L<br>nonionic (2) 1.5 g/L |
| 4 | 9 g/L | — | — | 0.05 g/L | $SO_4^{2-}$: 0.13 g/L | 0.5 g/L | ethylene glycol 2.0 g/L | nonionic (3) 1.0 g/L<br>nonionic (4) 2.0 g/L |
| 5 | — | 15 g/L | — | 1.00 g/L | $SO_4^{2-}$: 2.60 g/L | 0.5 g/L | ethylene glycol 2.0 g/L | nonionic (3) 1.0 g/L<br>nonionic (4) 2.0 g/L |

TABLE 2

| (Comparison Examples) | phosphoric acid as $PO_4$ | sulfuric acid as $SO_4$ | nitric acid as $NO_3$ | ferric ion $Fe^{3+}$ | ferric ion counterion | oxidant $H_2O_2$ | $C_2$–$C_{10}$ glycol | surfactant |
|---|---|---|---|---|---|---|---|---|
| 1 | 6 g/L | 9 g/L | 1.0 g/L | 0.05 g/L | $SO_4^{2-}$: 0.13 g/L | 0.5 g/L | — | nonionic (1) 0.5 g/L<br>nonionic (2) 1.5 g/L |
| 2 | 6 g/L | 9 g/L | 1.0 g/L | 0.05 g/L | $SO_4^{2-}$: 0.13 g/L | 0.5 g/L | — | nonionic (1) 0.5 g/L<br>nonionic (2) 1.5 g/L |
| 3 | — | 15 g/L | 1.0 g/L | 1.00 g/L | $SO_4^{2-}$: 2.60 g/L | 0.5 g/L | — | nonionic (1) 0.5 g/L<br>nonionic (2) 1.5 g/L |
| 4 | 9 g/L | — | — | 0.05 g/L | $SO_4^{2-}$: 0.13 g/L | 0.5 g/L | — | nonionic (3) 1.0 g/L<br>nonionic (4) 2.0 g/L |
| 5 | — | 15 g/L | — | 1.00 g/L | $SO_4^{2-}$: 2.60 g/L | 0.5 g/L | — | nonionic (3) 1.0 g/L<br>nonionic (4) 2.0 g/L |

In addition, aluminum ions are eluted during cleaning with the acidic liquid cleaner according to the present invention, and this may reduce its cleaning efficiency. Accordingly, as a countermeasure in response to this, a chelating agent which sequesters the aluminum ions may also be present.

Chelating agents useable for this purpose are exemplified by citric acid, oxalic acid, tartaric acid, gluconic acid, and the like.

The acidic liquid aluminum cleaner prepared according to the present invention is highly effective for the removal of smut and scale from aluminum and aluminum alloy as well as for the etching of same.

The practice of the invention may be further appreciated from the following working and comparison examples.

Examples The following general conditions applied to all the examples, unless otherwise noted:

1. Test material: Container fabricated by the drawing and ironing (hereinafter "DI") of 3004 alloy aluminum sheet and carrying normal DI lubricating oil and smut.
2. Preparation of the test baths: Five cleaners in total were prepared as examples, and their compositions 3. Test methods (a) Comparison of the maintenance of the surfactant concentration in the acidic liquid cleaners The test baths (Examples 1 to 5 from Table 1 and Comparison Examples 1 to 5 from Table 2) were maintained quiescent at 75°±1° C. while replenishing the decomposed $H_2O_2$ in order to maintain the $H_2O_2$ content in the bath at 0.5 g/L. The quantity of residual surfactant under quiescent acidic bath conditions was measured every 24 hours for three 24-hour intervals. The results are reported in Table 3.

TABLE 3

| | Surfactant Content After Time in Hours: 0 | 24 | 48 | 72 | Percent Decomposition in 72 Hr |
|---|---|---|---|---|---|
| Example Number | | | | | |
| 1 | 2.0 g/L | 1.9 g/L | 1.8 g/L | 1.7 g/L | 15% |
| 2 | 2.0 g/L | 1.9 g/L | 1.8 g/L | 1.8 g/L | 10% |
| 3 | 2.0 g/L | 1.9 g/L | 1.6 g/L | 1.5 g/L | 25% |
| 4 | 3.0 g/L | 2.9 g/L | 2.9 g/L | 2.7 g/L | 10% |
| 5 | 3.0 g/L | 2.8 g/L | 2.4 g/L | 2.2 g/L | 27% |
| Com- | | | | | |

TABLE 3-continued

| | Surfactant Content After Time in Hours: | | | | Percent Decomposition |
|---|---|---|---|---|---|
| | 0 | 24 | 48 | 72 | in 72 Hr |
| parison Examples | | | | | |
| 1 | 2.0 g/L | 1.7 g/L | 1.3 g/L | 1.2 g/L | 40% |
| 2 | 2.0 g/L | 1.7 g/L | 1.3 g/L | 1.2 g/L | 40% |
| 3 | 2.0 g/L | 1.6 g/L | 1.3 g/L | 1.1 g/L | 45% |
| 4 | 3.0 g/L | 2.7 g/L | 2.0 g/L | 1.8 g/L | 40% |
| 5 | 3.0 g/L | 2.5 g/L | 1.9 g/L | 1.6 g/L | 47% |

(b) Comparison of the cleaning activity for aluminum can (water-wetting test)

The test baths (Examples 1 to 5 from Table 1 and Comparison Examples 1 to 5 from Table 2) were maintained quiescent at 75°±1° C. while replenishing the decomposed $H_2O_2$ in order to maintain the $H_2O_2$ content in the bath at 0.5 g/L. A container as described above under the heading "Test material" was sprayed for 50 seconds at 75°±1° C. using the test bath after standing for zero, 24, 48, or 72 hours. This was followed by a spray rinse for 10 seconds with tap water and standing for 30 seconds. The water-wetted area (%) was then visually evaluated. The results for this evaluation are reported in Table 4.

TABLE 4

| Elapsed Time: (Hours) | 0 | 24 | 48 | 72 |
|---|---|---|---|---|
| Examples | | | | |
| 1 | 100% | 100% | 100% | 100% |
| 2 | 100% | 100% | 100% | 100% |
| 3 | 100% | 100% | 100% | 90% |
| 4 | 100% | 100% | 100% | 100% |
| 5 | 100% | 100% | 100% | 100% |
| Comparison Examples | | | | |
| 1 | 100% | 100% | 80% | 30% |
| 2 | 100% | 100% | 80% | 30% |
| 3 | 100% | 100% | 70% | 30% |
| 4 | 100% | 100% | 100% | 80% |
| 5 | 100% | 100% | 100% | 90% |

Considering the test results first as they relate to surfactant decomposition, the results reported in Table 3 show that it was possible to obtain an approximately 42 to 75% inhibition of surfactant decomposition. With regard to the maintenance of the cleaning activity, the results reported in Table 4 also show superior results obtained in the examples in all cases.

The invention claimed is:

1. An acidic liquid cleaner for aluminum having a pH not greater than 2.0 and consisting essentially of water and:

(A) a mineral acid component selected from the group consisting of phosphoric acid, sulfuric acid, nitric acid, and mixtures thereof, with the concentrations of phosphoric acid and sulfuric acid not more than 20 g/L each and the concentration of nitric acid not more than 10 g/L, (B) from 0.02 to 3.0 g/L of nitrite ions or hydrogen peroxide, (C) from 0.02 to 5 g/L of ferric ions, (D) from 0.1 to 5 g/L of nonionic surfactant, and (E) from 0.05 to 5 g/L of a component selected from the group of glycols containing from 2 to 10 carbon atoms per molecule and mixtures thereof, and, optionally, (F) a chelating agent which sequesters aluminum ions.

2. An acidic liquid cleaner for aluminum as claimed in claim 1, wherein the glycol component (E) comprises propylene glycol, ethylene glycol, diethylene glycol, or triethylene glycol.

3. An acidic liquid cleaner for aluminum as claimed in claim 2, wherein the pH is between 0.6 and 2.0.

4. An acidic liquid cleaner for aluminum as claimed in claim 1, wherein the pH is between 0.6 and 2.0.

5. A process for cleaning aluminum, comprising contacting the aluminum with an acidic liquid cleaner having a pH of not more than 2.0 and comprising mineral acid, oxidant, polyvalent metal ions, surfactant, and from 0.05 to 5 g/L of a component selected from the group consisting of glycols containing from 2 to 10 carbon atoms per molecule and mixtures thereof.

6. A process for cleaning aluminum as claimed in claim 5, wherein, in the acidic liquid cleaner, the mineral acid is selected from the group consisting of phosphoric acid, sulfuric acid, nitric acid, and mixtures thereof and the concentrations of phosphoric acid and sulfuric acid do not exceed 20 g/L each and the concentration of nitric acid does not exceed 10 g/L.

7. A process for cleaning aluminum as claimed in claim 5, wherein, in the acidic liquid cleaner, the oxidant is nitrite ions or hydrogen peroxide, in a concentration of from 0.02 to 3.0 g/L.

8. A process for cleaning aluminum as claimed in claim 5, wherein, in the acidic liquid cleaner, the pH is at least 0.6.

9. A process for cleaning aluminum as claimed in claim 5, wherein, in the acidic liquid cleaner, the polyvalent metal ions are ferric ions and are present at a concentration of from 0.02 to 5 g/L.

10. A process for cleaning aluminum as claimed in claim 9, wherein, in the acidic liquid cleaner, the pH is at least 0.6.

11. A process for cleaning aluminum as claimed in claim 5, wherein, in the acidic liquid cleaner, the surfactant is a nonionic surfactant and is present at a concentration of from 0.1 to 5 g/L.

12. A process for cleaning aluminum as claimed in claim 11, wherein, in the acidic liquid cleaner, the pH is at least 0.6.

13. A process for cleaning aluminum as claimed in claim 11, wherein, in the acidic liquid cleaner, the surfactant concentration is from 0.5 to 3 g/L.

14. A process for cleaning aluminum as claimed in claim 13, wherein, in the acidic liquid cleaner, the pH is at least 0.6.

15. A process for cleaning aluminum as claimed in claim 5, wherein the glycol component comprises propylene glycol, ethylene glycol, diethylene glycol, or triethylene glycol.

16. A process for cleaning aluminum as claimed in claim 15, wherein, in the acidic liquid cleaner, the pH is at least 0.6.

17. A process for cleaning aluminum as claimed in claim 15, wherein, in the acidic liquid cleaner, (i) the mineral acid is selected from the group consisting of phosphoric acid, sulfuric acid, nitric acid, the mixtures thereof; (ii) the concentrations of phosphoric acid and sulfuric acid do not exceed 20 g/L each and the concentration of nitric acid does not exceed 10 g/L; (iii) the oxidant is nitrite ions or hydrogen peroxide, in a concentration of from 0.02 to 3.0 g/L; (iv) the polyvalent metal ions are ferric ions and are present at a concentration of from 0.02 to 5 g/L; and the surfactant is a nonionic surfactant and is present at a concentration of from 0.1 to 5 g/L.

18. A process for cleaning aluminum as claimed in claim 17, wherein, in the acidic liquid cleaner, the pH is at least 0.6.

19. A process for cleaning aluminum as claimed in claim 17, wherein, in the acidic liquid cleaner, the surfactant concentration is from 0.5 to 3 g/L.

20. A process for cleaning aluminum as claimed in claim 19, wherein, in the acidic liquid cleaner, the pH is at least 0.6.

* * * * *

UNITED STATES PATENT AND TRADEMARK OFFICE

CERTIFICATE OF CORRECTION

PATENT NO. : 5,336,425

DATED : August 9, 1994

INVENTOR(S) : Aoki et al.

It is certified that error appears in the above-indentified patent and that said Letters Patent is hereby corrected as shown below:

On the title page, at Item [22], the "PCT filed" date should read --June 14, 1991--.

On the title page, at Item [86], "371 date" should read --Dec. 21, 1992--.

On the title page, at Item [86], "102(e) date" should read --Dec. 21, 1992--.

Signed and Sealed this

Thirty-first Day of January, 1995

*Attest:*

Bruce Lehman

BRUCE LEHMAN

*Attesting Officer*

*Commissioner of Patents and Trademarks*